US011414811B2

(12) United States Patent
Kim et al.

(10) Patent No.: US 11,414,811 B2
(45) Date of Patent: Aug. 16, 2022

(54) APPARATUS FOR TREATING LAUNDRY AND CONTROLLING METHOD THEREOF

(71) Applicant: LG Electronics Inc., Seoul (KR)

(72) Inventors: Woore Kim, Seoul (KR); Changoh Kim, Seoul (KR); Sangwook Hong, Seoul (KR)

(73) Assignee: LG Electronics Inc., Seoul (KR)

( * ) Notice: Subject to any disclaimer, the term of this patent is extended or adjusted under 35 U.S.C. 154(b) by 223 days.

(21) Appl. No.: 16/734,033

(22) Filed: Jan. 3, 2020

(65) Prior Publication Data

US 2020/0217007 A1 Jul. 9, 2020

(30) Foreign Application Priority Data

Jan. 4, 2019 (KR) ..... 10-2019-0001224

(51) Int. Cl.

| | |
|---|---|
| ***D06F 58/34*** | (2020.01) |
| ***D06F 58/30*** | (2020.01) |
| ***H05B 6/06*** | (2006.01) |
| ***H05B 6/10*** | (2006.01) |

(52) U.S. Cl.

CPC ..... *D06F 58/34* (2020.02); *D06F 58/30* (2020.02); *H05B 6/06* (2013.01); *H05B 6/10* (2013.01)

(58) Field of Classification Search

CPC ..... D06F 58/34; D06F 58/30; H05B 6/06; H05B 6/10

USPC ..... 34/523

See application file for complete search history.

(56) References Cited

U.S. PATENT DOCUMENTS

| | | | | |
|---|---|---|---|---|
| 3,733,712 A * | 5/1973 | Smith | G05D 22/02 | 34/532 |
| 4,267,643 A * | 5/1981 | Haried | D06F 58/46 | 34/553 |
| 5,101,575 A * | 4/1992 | Bashark | D06F 58/36 | 34/562 |
| 8,760,307 B2 * | 6/2014 | Falcioni | A47L 15/0063 | 340/657 |

(Continued)

FOREIGN PATENT DOCUMENTS

| | | |
|---|---|---|
| CN | 106811945 | 6/2017 |
| CN | 107208348 | 9/2017 |

(Continued)

OTHER PUBLICATIONS

Extended European Search Report in European Application No. 19219770.5, dated Apr. 14, 2020, 8 pages.

(Continued)

*Primary Examiner* — Stephen M Gravini

(74) *Attorney, Agent, or Firm* — Fish & Richardson P.C.

(57) ABSTRACT

Disclosed are an apparatus for treating laundry with an induction heater and controlling method thereof. In a laundry treating apparatus including an induction heater, the present invention includes a first step of setting a normal dry mode and an abnormal dry mode for controlling the induction heater with a output relatively lower than that of the normal dry mode, a second step of operating the induction heater in the normal dry mode, a third step of determining whether a dry load is a normal load or an abnormal load using at least one of a temperature of a drum and a current of a motor, and a fourth step of if the dry load is determined as the abnormal load, controlling the induction heater in the abnormal dry mode.

18 Claims, 8 Drawing Sheets

(56) References Cited

U.S. PATENT DOCUMENTS

| | | | | |
|---|---|---|---|---|
| 8,800,165 | B2 * | 8/2014 | Kwon | F26B 21/003 34/595 |
| 9,559,619 | B2 * | 1/2017 | Peterson | H02P 29/0241 |
| 10,590,595 | B2 * | 3/2020 | Kalze | H05B 6/06 |
| 11,021,837 | B2 * | 6/2021 | Bellm | D06F 58/20 |
| 2014/0189959 | A1 | 7/2014 | Dokonal et al. | |
| 2018/0057996 | A1 | 3/2018 | Park et al. | |
| 2018/0148886 | A1 * | 5/2018 | Kalze | D06F 58/34 |
| 2018/0282934 | A1 | 10/2018 | Kamii et al. | |
| 2020/0217007 | A1 * | 7/2020 | Kim | D06F 58/30 |
| 2021/0334641 | A1 * | 10/2021 | Kim | G06T 7/001 |

FOREIGN PATENT DOCUMENTS

| | | | | |
|---|---|---|---|---|
| CN | 107780120 | | 3/2018 | |
| DE | 102016110859 | | 6/2017 | |
| EP | 3287559 | | 2/2018 | |
| EP | 3677717 | A1 * | 7/2020 | H05B 6/10 |
| KR | 1020050114973 | | 12/2005 | |
| KR | 1020140028406 | | 3/2014 | |
| KR | 1020180045323 | | 5/2018 | |
| WO | WO2007102723 | | 9/2007 | |
| WO | WO-2020141785 | A1 * | 7/2020 | H05B 6/10 |

OTHER PUBLICATIONS

PCT International Search Report and Written Opinion in International Application No. PCT7KR2019/018361 dated Apr. 22, 2020, 11 pages.

Office Action in Chinese Appln. No. 201911408440.X, dated Dec. 30, 2021, 21 pages (with English translation).

* cited by examiner

APPARATUS FOR TREATING LAUNDRY AND CONTROLLING METHOD THEREOF

CROSS-REFERENCE TO RELATED APPLICATION

This application claims the benefit of the Korean Patent Application No. 10-2019-0001224, filed on Jan. 4, 2019, which is hereby incorporated by reference as if fully set forth herein.

BACKGROUND OF THE INVENTION

Field of the Invention

The present invention relates to an apparatus for treating laundry and controlling method thereof, and more particularly, to an apparatus for treating laundry with an induction heater and controlling method thereof.

Discussion of the Related Art

Generally, a laundry treating device is a device for washing, drying and/or refreshing laundry. Refreshing means to remove dust of laundry, smooth the creases of laundry, or sterilize laundry using air, steam and the like. Examples of a laundry treating device include a washer, a drier and a refresher. The refresher is a sort of a laundry caring device (or a laundry cleaner) and its product name is called 'Tromm Styler' by LG Electronics, or the like.

A laundry treating device is normally provided with a heater. And, an electric heater or a gas heater is used as the heater in general. Recently, an induction heater configured to use the principle of induction heating is proposed. The induction heater generates an induced current to heat a conductor. Generally, an induction heater heats a drum that is a conductor, and wash water, air, laundry, substance to be dried or the like is heated by the heated drum.

In a laundry treating device using an electric or gas heater, the heat of hot air heated by the electric or gas heater is transferred to a thing to be dried (hereinafter, a dry load) through convective heat transfer. Once a dry cycle starts, an output of a heater is maximized. If a temperature of hot air heated by the heater (such a temperature shall be named a hot air temperature) becomes equal to or greater than a specific temperature, the heater is turned off. If the hot air temperature becomes lower than the specific temperature, the heater is turned on. In such a mater, the hot air is adjusted. For example, by turning on and off the heater with reference to the hot air temperature between 110° C. and 174° C., the hot air temperature is maintained at the average level of 150° C.

As described above, since heat is transferred to a dry load by convective heat transfer according to such a method, although a heater is turned on to the maximum from the beginning of a dry cycle, the dry load is not damaged or overheated.

However, in a laundry treating device with an induction heater, a drum that is a conductor is heated instead of supplying hot air to a tub. Namely, in case of the induction heater, heat is transferred to a dry load through drum conduction and heat conductivity varies according to a moisture state of the dry load. Hence, in case of a dry load such as an empty drum, a small load less than 1 kg, a dry sheet, a partially wet comforter in large volume, or the like, a dry load may be damaged or overheated partially by the heated drum.

Thus, in a laundry treating device using an induction heater, it is difficult to exactly apply a dry control used for an electric or gas heater of the related art. Therefore, the demand for developing a dry control appropriate for a laundry treating device using an induction heater is rising.

SUMMARY OF THE INVENTION

Accordingly, the present invention is directed to an apparatus for treating laundry and controlling method thereof that substantially obviate one or more problems due to limitations and disadvantages of the related art.

One object of the present invention is to provide an apparatus for treating laundry and controlling method thereof, by which a dry efficiency can be enhanced despite using an induction heater.

Another object of the present invention is to provide an apparatus for treating laundry and controlling method thereof, by which each dry load can be appropriately dried despite using an induction heater.

Further object of the present invention is to provide an apparatus for treating laundry and controlling method thereof, by which a dry load can be prevented from being overheated or damaged despite using an induction heater.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To solve the above problems, the present invention defines a normal dry mode and an abnormal dry mode for controlling the induction heater with an output relatively lower than that of the normal dry mode. And, whether a dry load is a normal load or an abnormal load is determined using at least one of a temperature of a drum and a current of a motor. If the dry load is determined as the abnormal load, the induction heater is controlled in the abnormal dry mode.

To achieve these objects and other advantages and in accordance with the purpose of the invention, as embodied and broadly described herein, a method of controlling a laundry treating apparatus including an induction heater according to an exemplary embodiment of the present invention may include a first step of setting a normal dry mode and an abnormal dry mode for controlling the induction heater with a output relatively lower than that of the normal dry mode, a second step of operating the induction heater in the normal dry mode, a third step of determining whether a dry load is a normal load or an abnormal load using at least one of a temperature of a drum and a current of a motor, and a fourth step of if the dry load is determined as the abnormal load, controlling the induction heater in the abnormal dry mode.

According to an exemplary embodiment, in the third step, if a temperature increase rate of the drum is equal to or greater than a prescribed value, the dry load may be determined as the abnormal load. If a current fluctuation of the motor lies within a prescribed range, the dry load may be determined as the abnormal load.

According to an exemplary embodiment, if the dry load is determined as the normal load according to the temperature increase rate of the drum, whether the dry load is the abnormal load may be determined again according to the current fluctuation of the motor.

According to an exemplary embodiment, at least one of an output value of the induction heater, a target temperature of the drum and an output decrease value of the induction motor may be defined in the normal dry mode, an output value of the induction heater and a target temperature of the drum in the abnormal mode may be smaller than the output value of the induction heater and the target temperature of the drum in the normal dry mode, respectively, and an output decrease value of the induction motor in the abnormal dry mode may be greater than the output decrease value of the induction motor in the normal dry mode.

In another aspect of the present invention, an apparatus for treating laundry may include a cabinet, a tub provided within the cabinet, a drum provided within the tub to receive a dry load therein, a motor driving the drum, an induction heater provided to the tub to heat the drum by induction, a temperature sensor measuring a temperature of the drum, a current sensor measuring a current of the motor, and a controller configured to set a normal dry mode and an abnormal dry mode for controlling the induction heater with a output relatively lower than that of the normal dry mode, determine whether a dry load is a normal load or an abnormal load using at least one of a temperature of a drum and a current of a motor, and control the induction heater in the abnormal dry mode if the dry load is determined as the abnormal load.

According to an exemplary embodiment, if a temperature increase rate of the drum is equal to or greater than a prescribed value, the dry load may be determined as the abnormal load. If a current fluctuation of the motor lies within a prescribed range, the dry load may be determined as the abnormal load.

According to an exemplary embodiment, if the dry load is determined as the normal load according to the temperature increase rate of the drum, whether the dry load is the abnormal load may be determined again according to the current fluctuation of the motor.

The respective features of the aforementioned embodiment can be complexly implemented in other embodiments unless contradictory or exclusive.

Accordingly, an apparatus for treating laundry and controlling method thereof according to the preset disclosure provide the following effects and/or advantages.

First of all, according to the present invention, a dry efficiency can be enhanced despite using an induction heater.

Secondly, according to the present invention, each dry load can be appropriately dried despite using an induction heater.

Thirdly, according to the present invention, a dry load can be prevented from being overheated or damaged despite using an induction heater.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

A laundry treating device according to an embodiment of the present invention will be described with reference to the accompanying drawings. Description will now be given in detail according to specific embodiments disclosed herein, with reference to the accompanying drawings. Yet, the embodiments and drawings are used to help the understanding of the present invention. Moreover, to help the understanding of the present invention, the accompanying drawings may be illustrated in a manner of exaggerating sizes of some components instead of using a real scale. Thus, the present invention is non-limited to the following embodiment, and it is intended that the present invention covers the modifications and variations of this invention provided they come within the scope of the appended claims and their equivalents.

Figure 1:
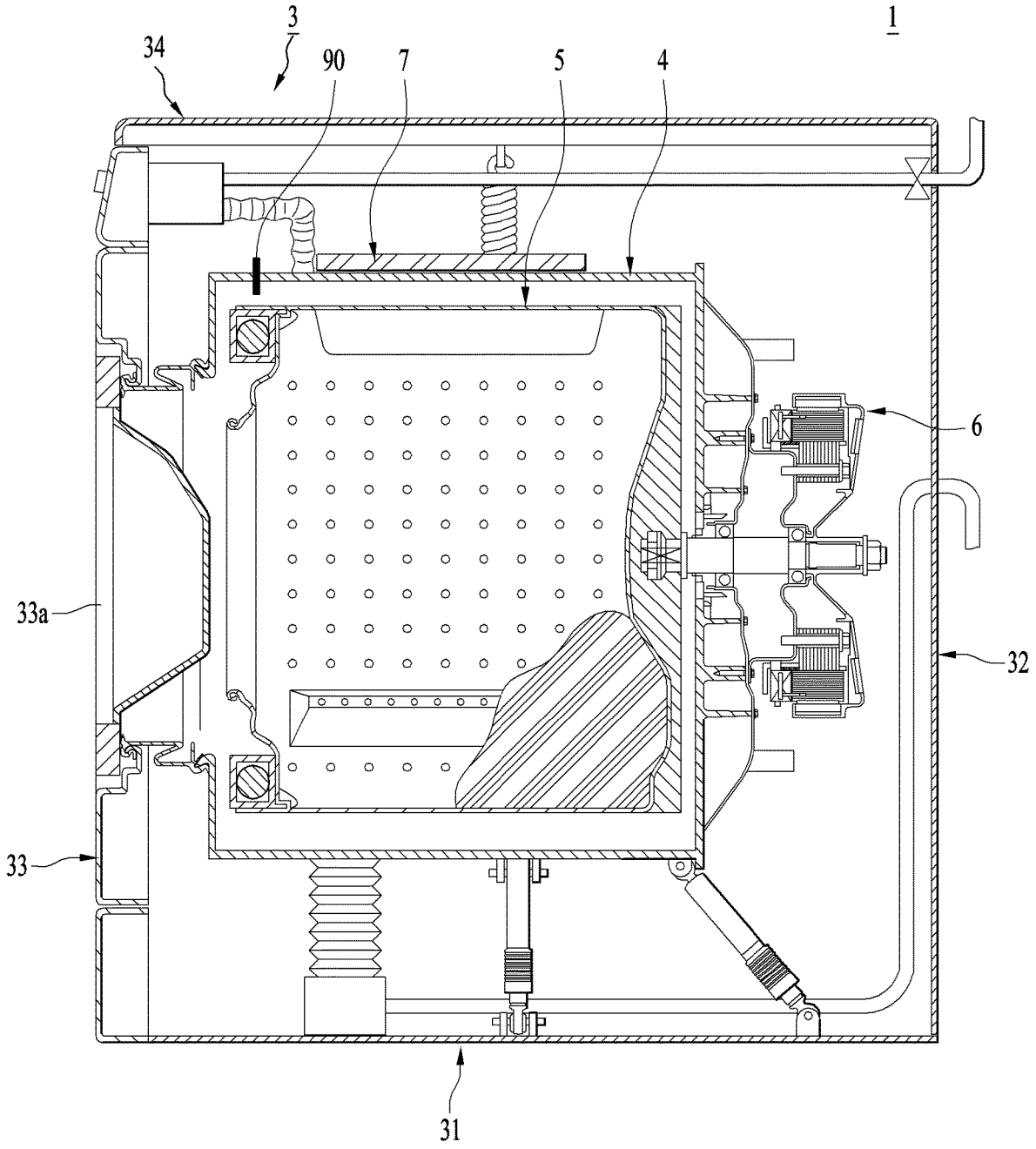
FIG. 1 is a cross-sectional section diagram showing a general laundry treating device schematically.

First of all, an overall structure of a laundry treating device according to an embodiment of the present invention is described with reference to FIG. 1. In the following, a washer 1 will be taken as an example of the laundry treating device.

A tub 4 is provided within a cabinet 3. A drum 5 is rotatably provided within the tub 4. And, a motor 6 configured to rotate the drum 5 may be provided to a rear side of the tub 4. The cabinet 3 preferably includes a base 31, a front panel 33, a rear panel 32, a side panel (not shown) and a top panel 34. A door 33*a* is preferably provided to the front panel 33.

In some implementations, an induction heater 7 may be provided to a prescribed position, and more preferably, to an outside of the tub 4. The drum 5 is preferably made of conductor, e.g., metal material. The induction heater 7 heats the drum 5 by induction and wash water, air, laundry, a dry load and the like are heated by the heated drum 5.

A temperature sensor 90 configured to measure a temperature of the drum 5 may be provided to a prescribed spot of the tub 4. A type of the temperature sensor 90 is non-limited, and may use a thermistor, an infrared sensor, etc.

Meanwhile, as described above, in the dry cycle using the induction heater 7, if the same dry control of the dry cycle of the electric or gas heater of the related art, a dry load may be possibly damaged or overheated in part. Therefore, for the dry cycle using the induction heater, a dry control appropriate therefor is required.

Prior to describing a dry treating apparatus and control method thereof according to the present invention, the principle of the present embodiment is described as follows.

The present invention proposes to vary a dry control for each case by classifying a dry load. For example, each dry control is varied by classifying a dry load in a dry cycle into a dry load free from the possibility of damage or overheating [hereinafter 'normal load'] or a dry load having the possibility of damage or overheating [hereinafter 'abnormal load']. A dry load is prevented from being damaged or overheated in a manner of controlling an induction heater in a normal dry mode for a normal load or in an abnormal dry mode for an abnormal load. [Normal dry mode and abnormal dry mode will be described later.]

As a result of study, a dry load having an appropriate moisture content, weight and volume is free from the possibility of the damage or overheating. Yet, a dry load having an inappropriate moisture content, weight and volume has the possibility of the damage or overheating. For example, an empty drum, an extremely small load, a dry sheet load having a small moisture content, a comforter, a load closely adhering to a drum and the like may have the possibility of damage or overheating in a dry process.

A method of determining a normal load and an abnormal load is described as follows.

An appropriate moister content, weight and volume are defined, and a normal load and an abnormal load are then determined with reference to the definitions. Yet, it is not easy to define an appropriate moister content, weight and volume, and it is difficult to sense the appropriate moister content, weight and volume.

Yet, according to a study result, whether a dry load is normal or abnormal could be determined using the variation of a drum temperature and the fluctuation of a motor current.

Figure 2:
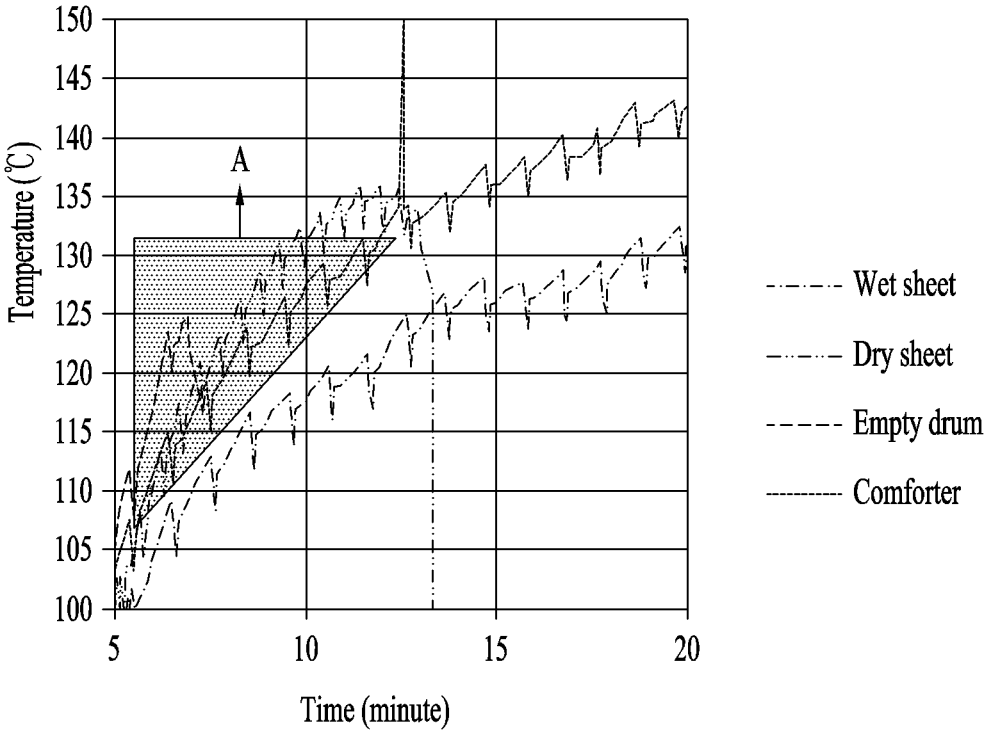
FIG. 2 is a graph showing variation of a drum temperature according to a type of a dry load.

First of all, with reference to FIG. 2, how to determine a normal load and an abnormal load is described using a variation of a drum temperature.

In FIG. 2, when dry loads of various types are dried, a temperature of a drum is measured. The temperature of the drum is measured using a thermistor as a temperature sensor (See '90' in FIG. 1).

As a test result, a normal load and an abnormal load differ from each other in a temperature change of a drum when the drum is heated initially. As shown in FIG. 2, a normal load such as a wet sheet and an abnormal load such as a dry sheet, an empty drum, a comforter or the like differ from each other in a temperature increase rate (e.g., slope).

Namely, the temperature increase rate of the abnormal load is greater than that of the normal load. The abnormal load has a small moisture content, whereas the normal load has an appropriate moisture content. Hence, the temperature increase rate of the abnormal load is greater than that of the normal load. Thus, by sensing a temperature increase value within a predetermined time, a normal load or an abnormal load may be determined. For example, in FIG. 2, a dry load having a temperature increase rate such as a range A may be determined as an abnormal load.

Meanwhile, determining a dry load as a normal or abnormal load with reference to a temperature increase rate of a drum is a qualitative meaning. Hence, a reference value or range of a temperature increase rate of a drum to determine a normal or abnormal load quantitatively is non-limited to an absolute value but may be pre-determined through an appropriate simulation or test.

In some implementations, in a dry cycle using an induction heater, it is preferable to consider other factors as well as a moisture content of a dry load. For example, it is preferable to consider whether a dry load circulates within a drum in a dry cycle [a circulating state of a dry load]. Namely, since a drum is heated in a dry cycle using an induction heater, if a dry load adheres closely to the drum instead of circulating, the dry load may be possibly damaged or overheated.

For example, in case of a comforter in a large volume that fills up an inside of a drum, since the volume of the comforter is large despite that the drum rotates, the comforter rotates together with the drum instead of circulating within the drum. If so, a portion of the comforter attached to the drum is dried rapidly, whereby the dried portion may be damaged before heat is transferred into the comforter. Therefore, it is preferable to determine a normal or abnormal load by considering a circulating state of a dry load within a drum in a dry cycle.

A method of determining a normal or abnormal load by considering a circulating state of a dry load in a drum is described with reference to FIG. 3 and FIG. 4.

Figure 3:
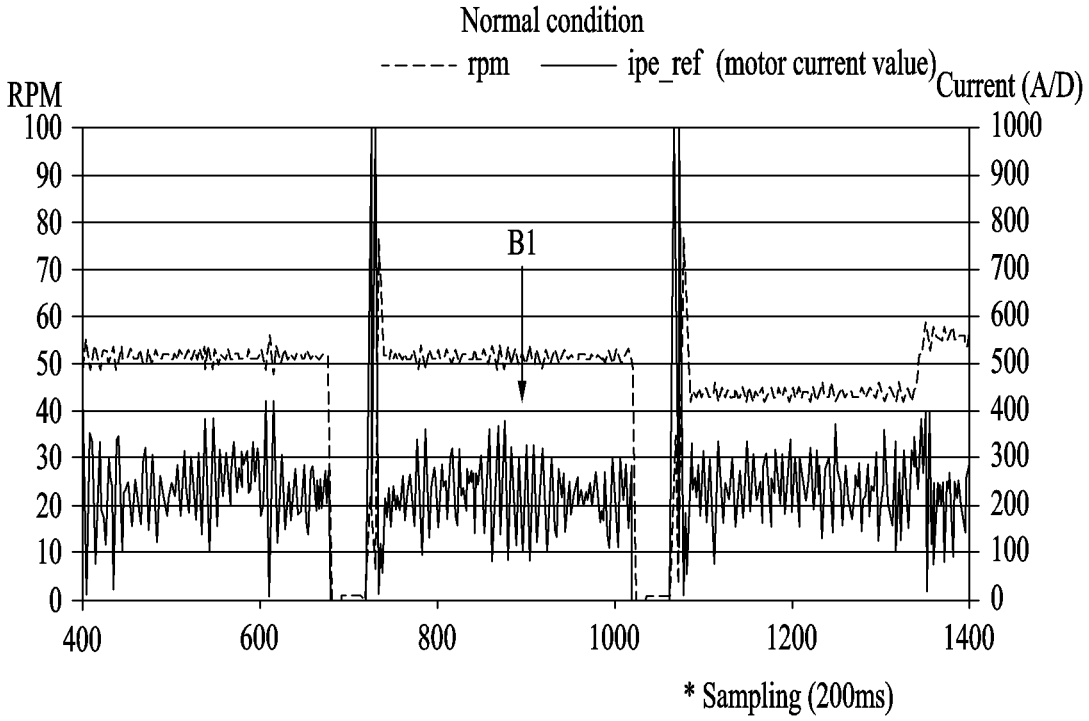
FIG. 3 and FIG. 4 are graphs showing fluctuation of motor current according to a type of a dry load.

In FIG. 3, when a dry load having a good circulating state, i.e., a normal load is dried in a drum, a motor current is measured. In FIG. 4, when a dry load having a poor circulating state, i.e., an abnormal load is dried in a drum, a motor current is measured. As a test result, the normal load and the abnormal load differ from each other in fluctuation of the motor current.

As shown in FIG. 3, in case of a normal load, fluctuation of a motor current is significant (See B1 of FIG. 3). As a dry load circulates smoothly within a drum, the fluctuation of the motor current is regarded as significant.

Figure 4:
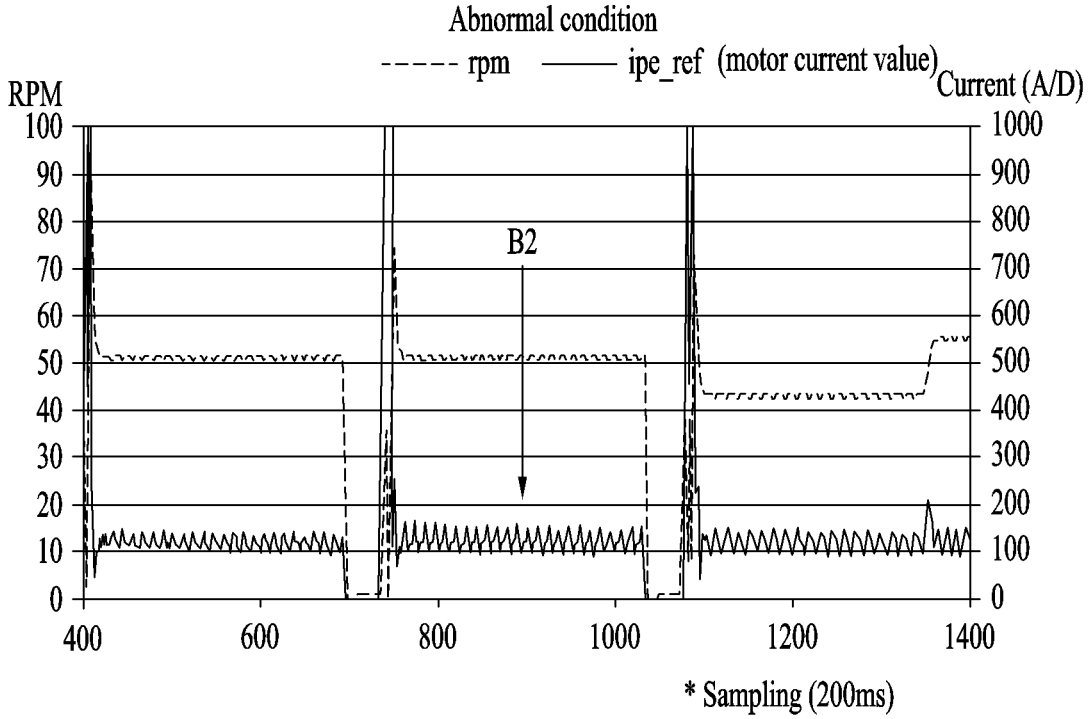

On the contrary, as shown in FIG. 4, in case of an abnormal load, there is almost no fluctuation of a motor current (See B2 of FIG. 4). In FIG. 4, a comforter having a large volume, a dry load adhering to a drum after a dewater w\cycle and the like are tested. As there is almost no circulation of a dry load within a drum in the course of a dry cycle and the dry load circulates by closely adhering to the drum, it is regarded that there is almost no fluctuation of the motor current.

As described above, a normal load or an abnormal load may be determined by obtaining a circulating state of a dry load within a drum in a manner of detecting a fluctuation of a motor current. Determining a normal or abnormal load is determined with reference to a fluctuation of a motor current is a qualitative meaning. Hence, a reference value or range of a motor current's fluctuation to determine a normal or abnormal load quantitatively is non-limited to an absolute value and pre-determined through an appropriate simulation or test.

According to the above description, whether a dry load is a normal or abnormal load is determined using a temperature increase rate of a drum or a fluctuation of a motor current. In the following description, whether a dry load is a normal/abnormal load is determined by combining the above two manners.

Figure 5:
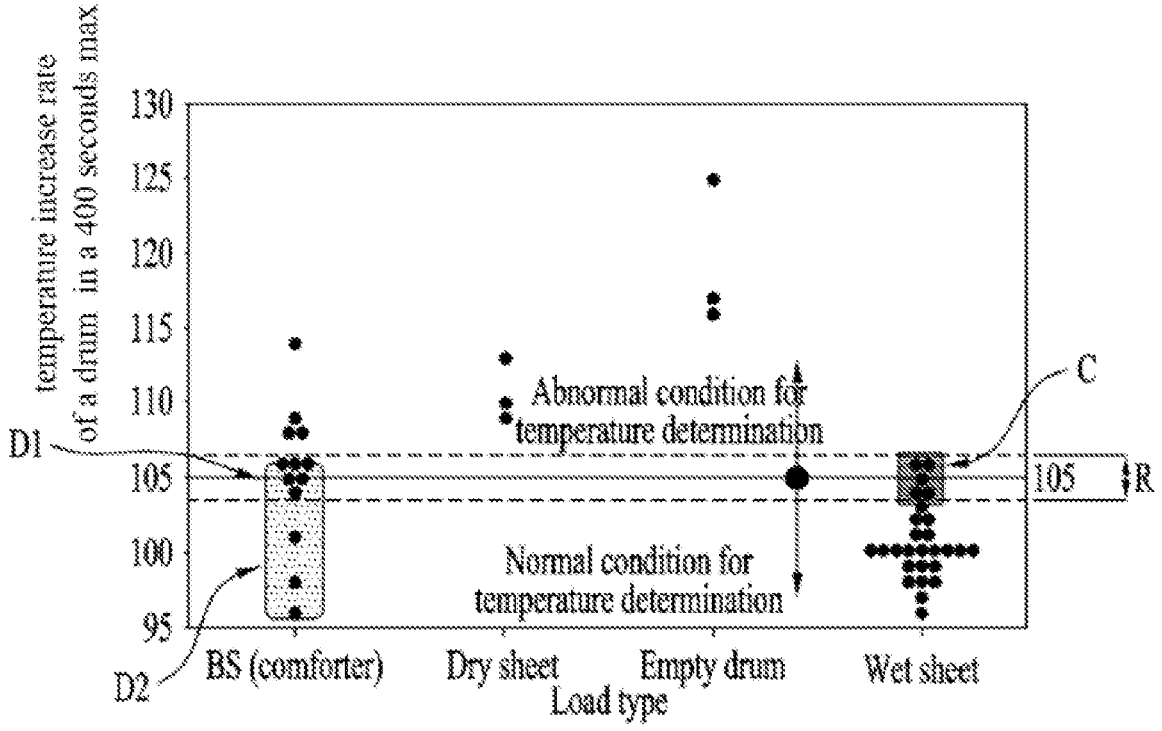
FIG. 5 is a graph showing variation of a drum temperature according to a type of a dry load.
Figure 6:
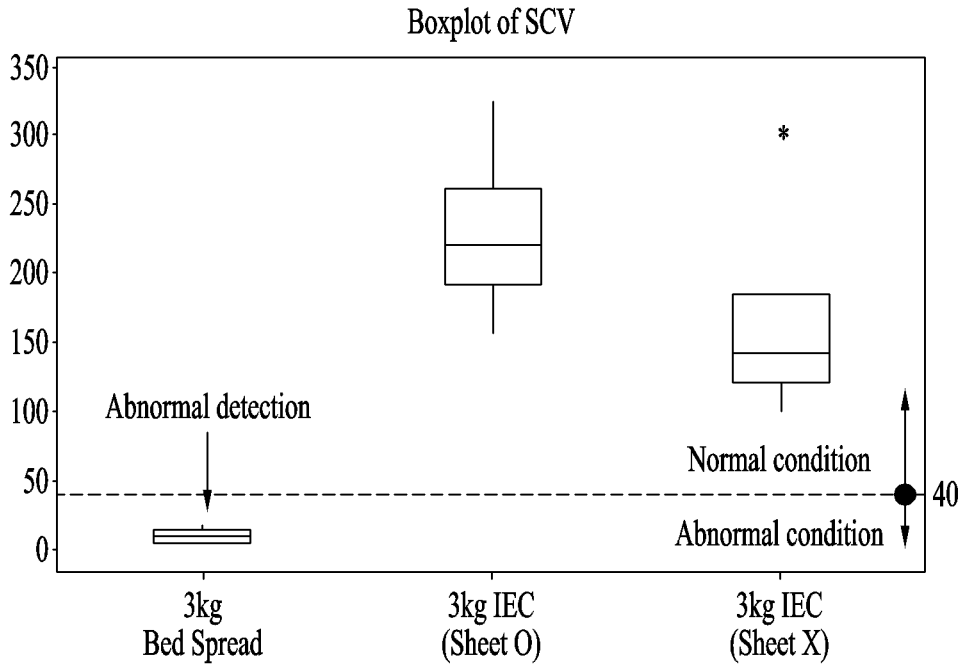
FIG. 6 is a graph showing fluctuation of motor current according to a type of a dry load.

With reference to FIG. 5 and FIG. 6, a method of determining a normal/abnormal load by combing a temperature increase rate of a drum and a fluctuation of a motor current together is described.

FIG. 5 is a graph showing variation of a drum temperature according to a type of a dry load. For example, a reference value of a temperature increase rate of a drum for determining a normal or abnormal load is 105. Namely, if the temperature increase rate is equal to or greater than 105, a dry load may be determined as an abnormal load. If the temperature increase rate is smaller than 105, a dry load may be determined as a normal load.

Yet, depending on a type of a dry load, there may be a case that it is difficult to determine a normal or abnormal load with a temperature increase rate of a drum. As shown in FIG. 5, a dry load such as a dry sheet, an empty drum or the like has a drum's temperature increase rate much greater than the reference value of 105. Hence, it is relatively easy to determine a dry load such as a dry sheet, an empty drum or the like as an abnormal load using the temperature increase rate of the drum.

On the other hand, as shown in FIG. 5, in case of a wet sheet, since a temperature increase rate of a drum is mostly smaller than 105, it is determined as a normal load. Yet, a prescribed wet sheet C is located in a prescribed range R above and below a temperature increase rate reference value '105' of the drum. If the temperature increase rate of the drum is located in the prescribed range R, it is difficult to conclude that it is a normal or abnormal load. In such a case, since a wet sheet is attached to an inner wall of the drum in a dry cycle, circulation of the wet sheet is regarded as not smoothly performed. Moreover, in case of a comforter, since a temperature increase rate of a prescribed comforter D1 is located in a prescribed range R of a reference value, it is difficult to conclude that it is a normal or abnormal load.

Furthermore, in case of the comforter, since a reference value of the temperature increase rate of the drum is smaller than 105, although it is determined as a normal load, as the comforter is attached to the drum in a dry cycle, it may happen that the comforter does not circulate within the drum. Namely, in case of the comforter, although it is determined as a normal load according to the temperature increase rate of the drum [D2 of FIG. 5], as shown in FIG. 6, if a fluctuation of a motor current is determined, it may happen that the comforter is determined as an abnormal load.

Therefore, whether a dry load is a normal or abnormal load is preferably determined by combining a temperature increase rate of a drum and a fluctuation of a motor current together.

As a study result, whether a dry load such as an empty drum, an extremely small amount, a dry sheet, a small-size comforter or the like is a normal/abnormal load could be determined with ease relatively using a dry load such as a dry sheet, an empty tank or the like of a drum. And, whether a comforter in a medium size or larger or a dry load closely adhering to the drum is a normal/abnormal load is preferably determined using a fluctuation of a motor current.

Therefore, after a normal/abnormal load has been determined using a temperature increase rate of a drum, although it is determined as the normal load according to the temperature increase rate of the drum, a normal/abnormal load is preferably determined again using a fluctuation of a motor current.

Embodiments of an apparatus for treating laundry and controlling method thereof according to the present invention are described with reference to FIG. 7 and FIG. 8.

Figure 7:
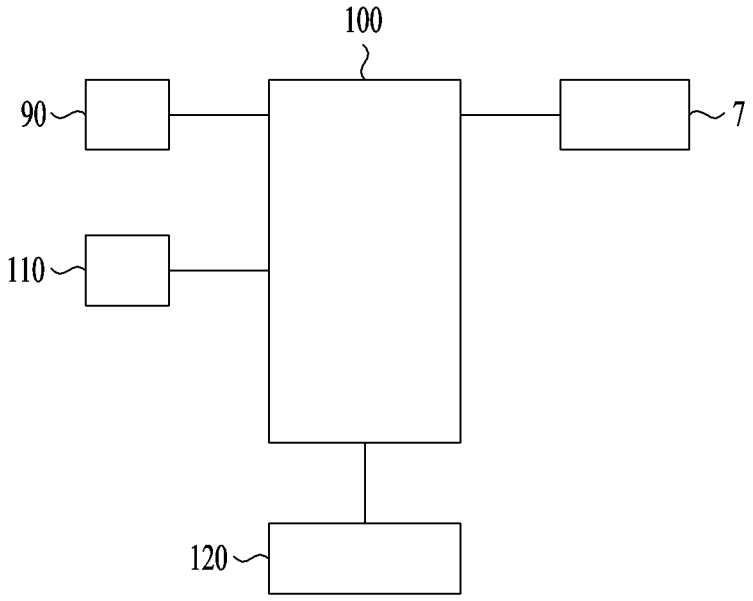
FIG. 7 is a block diagram showing a control relevant configuration of a laundry treating apparatus according to an embodiment of the present invention.
Figure 8:
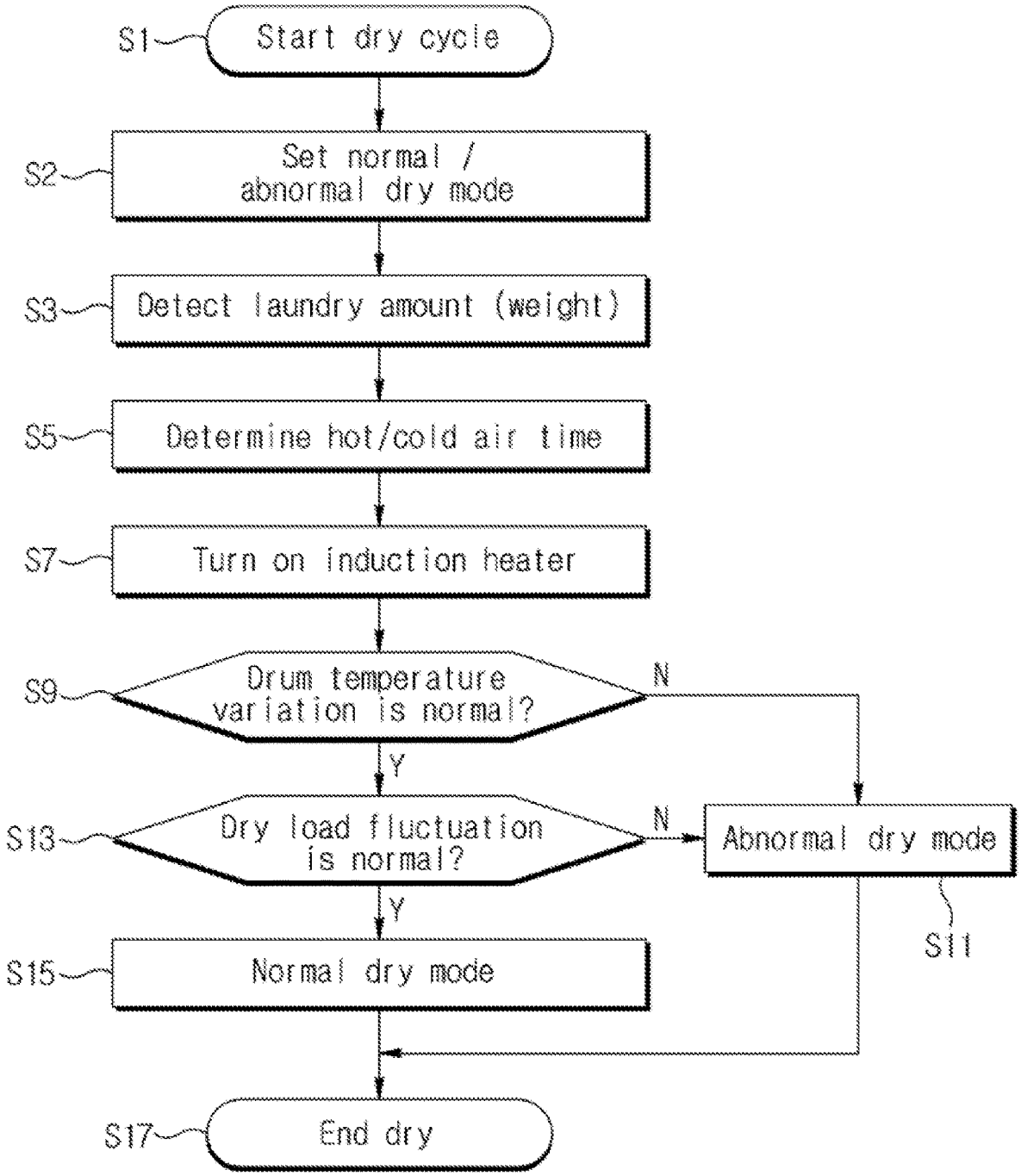
FIG. 8 is a flowchart showing a method of controlling a laundry treating apparatus according to an embodiment of the present invention.

First of all, with reference to FIG. 7, a configuration of an embodiment of a laundry treating apparatus according to the present invention is described from the perspective of control.

A temperature sensor 90 detecting a temperature of a drum is connected to an input side of a controller 100. And, a current sensor 110 sensing a current of a motor is connected to the input side of the controller 100. An induction heater 7 is connected to an output side of the controller 100. And, a memory 120 is preferably connected to the controller 100.

Here, the controller 100, the temperature sensor 90, the current sensor 110, the induction heater 7, the memory 120 and the like are classified in functional aspect for clarity. Hence, it may not mean that they should be separated by hardware or software. For example, the controller 100 may be provided to a main controller of the laundry treating apparatus in form of software.

A method of controlling a laundry treating apparatus according to an embodiment of the present invention is described with reference to FIG. 7 and FIG. 9.

First of all, a normal dry mode and an abnormal dry mode are described. In the normal dry mode and the abnormal dry mode, various control factors used for a dry cycle may be included. For example, the normal dry mode and the abnormal dry mode may be defined using an output value of an induction motor, a hot air dry time in a dry cycle, a cold air dry time therein, etc.

Here, the normal/abnormal dry mode does not mean that a control value for a prescribed control factor is determined as a specific value. Namely, since a dry load may be possibly damaged or overheated in case of progressing a dry cycle in a normal dry mode, it relatively means that a relatively different control value is used in the abnormal dry mode in comparison with the normal dry mode. For example, it may mean that the induction heater is controlled with a low output relatively and eventually in the abnormal dry mode compared to the normal dry mode.

For example, several examples of the normal dry mode and the abnormal dry mode are described.

For example, if an induction heater is operated with a maximum output only in the normal dry mode, it may be operated with a low output smaller than the maximum output in the abnormal dry mode. Moreover, for example, if the induction motor and the like are controlled in a manner that a temperature of a drum is maintained at the average of 150° C., the induction heater and the like may be controlled in a manner that the average temperature of the drum becomes a temperature lower than 150° C., i.e., 110~120° C. in the abnormal dry mode. Moreover, for example, when the output of the induction heater is lowered, it is lowered by 1 step each in the normal dry mode or by 2 steps each in the abnormal dry mode.

In some implementations, various control factors for the aforementioned normal and abnormal dry modes are preferably pre-stored in form of a prescribed table in a memory.

A method of controlling a laundry treating apparatus according to one embodiment of the present invention is described as follows.

First of all, a normal dry mode and an abnormal dry mode are set [S2]. This may mean that control values of various control factors of the normal and abnormal dry modes are stored by being pre-defined.

Subsequently, a laundry amount of a dry load is sensed [S3]. Based on the sensed laundry amount, various control factors in the normal dry mode are determined. The control factors of a dry cycle may include an output value of an induction heater, a hot air dry time, a cold air dry time, etc. For clarity of the following description, the induction heater is set to a maximum output irrespective of a dry load amount and the hot air dry time and the cold air dry time are controlled according to the laundry amount, for example.

The hot air dry time and the cold air dry time are determined according to the sensed laundry amount [S5]. The induction heater is turned on [S7].

Subsequently, whether a drum temperature variation is normal is determined [S9]. For example, whether the drum temperature variation is normal may be determined with reference to a temperature increase rate of the drum. If the temperature increase rate of the drum is equal to or greater than a prescribed value, it may be determined as an abnormal load. If it is determined as the abnormal load, the induction heater is controlled in the abnormal dry mode [S11].

If the drum temperature variation is normal, it is determined whether a dry load fluctuation is normal [S13]. For example, whether the dry load fluctuation is normal may be determined using a fluctuation of a motor current. If there is almost no fluctuation of the motor current, it is determined as an abnormal load. If it is determined as the abnormal load, the induction heater is controlled in the abnormal dry mode [S11].

If the drum temperature variation and the dry load fluctuation are normal, the induction heater is controlled in the normal dry mode [S15].

The present embodiment is described by taking an example that an induction heater is set to a maximum output in a dry cycle irrespective of a laundry amount. Yet, it is possible to separately set an output of the induction heater in association with a laundry amount. Moreover, although both a drum temperature variation and a dry load fluctuation are used in the description of the present embodiment, it is possible to determine a normal/abnormal load using one of the two only.

Meanwhile, a part that is not separately described in each of the above-described embodiments may employ at least one matter of another embodiment identically. Moreover, one technical matter described in a prescribed embodiment is exactly applicable to another embodiment unless contrary to each other without being mentioned specially.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

For example, although a washer is taken as an example for description, the principle of the present invention is also applicable to a drier, a refresher, etc.

What is claimed is:

1. A method of controlling a laundry treating apparatus including an induction heater, the method comprising:

setting a condition for determining that a laundry load is a normal load or an abnormal load;

driving the induction heater in a normal dry mode;

determining, with reference to the set condition and based on at least one of a temperature increase rate of a drum of the laundry treating apparatus or a current fluctuation of a motor of the laundry treating apparatus, whether the laundry load is the normal load or the abnormal load during driving of the induction heater in the normal dry mode; and controlling, based on a determination that the laundry load is the abnormal load, the induction heater in an abnormal dry mode, wherein an output of the induction heater in the abnormal dry mode is less than an output of the induction heater in the normal dry mode.

2. The method of claim 1, wherein determining whether the laundry load is the normal load or the abnormal load comprises:

determining that the laundry load is the abnormal load based on at least one of the temperature increase rate of the drum being equal to or greater than a preset value or the current fluctuation of the motor being within a preset range.

3. The method of claim 2, wherein determining whether the laundry load is the normal load or the abnormal load comprises:

determining that the laundry load is the abnormal load based on the temperature increase rate of the drum being less than the preset value and the current fluctuation of the motor being within the preset range.

4. The method of claim 1, wherein at least one of an output value of the induction heater, a target temperature of the drum, or an output decrease value of the induction heater is defined in the normal dry mode, wherein an output value of the induction heater and a target temperature of the drum in the abnormal dry mode are less than the output value of the induction heater and the target temperature of the drum in the normal dry mode, respectively, and wherein an output decrease value of the induction heater in the abnormal dry mode is greater than the output decrease value of the induction heater in the normal dry mode.

5. An apparatus for treating laundry, comprising:

a cabinet;

a tub located in the cabinet;

a drum located in the tub and configured to receive laundry;

a motor located in the cabinet and configured to drive the drum;

an induction heater located at the tub and configured to heat the drum by induction;

a temperature sensor configured to measure a temperature inside the drum;

a current sensor configured to measure a current applied to the motor; and a controller configured to:

set a condition for determining that a laundry load is a normal load or an abnormal load;

drive the induction heater in a normal dry mode;

determine, with reference to the set condition and based on at least one of a temperature increasing rate of the drum or fluctuation of the current applied to the motor, whether the laundry load is the normal load or the abnormal load during driving of the induction heater in the normal dry mode; and control, based on a determination that the laundry load is in the abnormal load, the induction heater in an abnormal dry mode, wherein an output of the induction heater in the abnormal dry mode is less than an output of the induction heater in the normal dry mode.

6. The apparatus of claim 5, wherein the laundry load is determined to be the abnormal load based on at least one of a temperature increase rate of the drum being equal to or greater than a preset value or the fluctuation of the current applied to the motor being within a preset range.

7. The apparatus of claim 6, wherein the laundry load is determined to be the abnormal load based on the temperature increase rate of the drum being less than the preset value and the fluctuation of the current of the motor being within the preset range.

8. The method of claim 1, further comprising:

determining control factors of the normal dry mode that include an output value of the induction heater, a hot air dry time, and a cold air dry time.

9. The method of claim 8, further comprising determining the hot air dry time and the cold air dry time according to an amount of the laundry load.

10. The method of claim 9, further comprising turning on the induction heater according to a determination of the hot air dry time and the cold air dry time.

11. The method of claim 1, further comprising determining whether a temperature variation of the drum is normal according to the temperature increase rate of the drum.

12. The method of claim 11, further comprising determining, based on a determination that the temperature variation of the drum is normal, whether a laundry load fluctuation is normal.

13. The method of claim 12, further comprising controlling, based on a determination that the temperature variation of the drum and the laundry load fluctuation are normal, the induction heater in the normal dry mode.

14. The method of claim 13, further comprising determining whether the laundry load is the normal load or the abnormal load, based on at least one of the temperature variation of the drum or the laundry load fluctuation.

15. The method of claim 1, further comprising setting, irrespective of the laundry load, the induction heater to a maximum output in the normal dry mode or in the abnormal dry mode.

16. The method of claim 1, further comprising separately setting the output of the induction heater according to the laundry load.

17. The method of claim 1, wherein the output of the induction heater in the abnormal dry mode and the output of the induction heater in the normal dry mode are adjusted differently.

18. The apparatus of claim 5, wherein the output of the induction heater in the abnormal dry mode and the output of the induction heater in the normal dry mode are adjusted differently.

* * * * *